United States Patent [19]

Okada

[11] 4,301,594

[45] Nov. 24, 1981

[54] HANDY ROTARY CUTTER

[75] Inventor: Yoshio Okada, Osaka, Japan

[73] Assignee: Okada Kogyo Kabushiki Kaisha, Osaka, Japan

[21] Appl. No.: 149,955

[22] Filed: May 15, 1980

[30] Foreign Application Priority Data

Oct. 18, 1979 [JP] Japan ..... 54-144516[U]

[51] Int. Cl.[3] ..... B26B 25/00

[52] U.S. Cl. ..... 30/164.95; 30/292; 30/307

[58] Field of Search ..... 30/151, 162, 164.95, 30/292, 294, 307

[56] References Cited

U.S. PATENT DOCUMENTS

| | | | |
|---|---|---|---|
| 278,103 | 5/1883 | Curtis | 30/307 X |
| 1,073,592 | 9/1913 | Contenti | 30/162 |
| 1,306,783 | 6/1919 | Smolinsky | 30/307 X |
| 1,534,576 | 4/1925 | Edgren | 30/292 |
| 2,568,353 | 9/1951 | Miseta | 30/162 X |
| 3,590,483 | 7/1971 | Szczepanski | 30/151 |

*Primary Examiner*—Jimmy C. Peters

*Attorney, Agent, or Firm*—Wenderoth, Lind & Ponack

[57] ABSTRACT

A rotary cutter comprises a generally elongated plate-like handle having a bearing aperture defined at one end thereof, a shaft member supported by the handle and extending through the bearing aperture, a disc blade rotatably mounted on the shaft and lying in a plane perpendicular to the longitudinal axis of the shaft member and in parallel to any one of the opposed surfaces of the handle, and a device for adjustably applying a frictional force to the disc blade in a direction generally perpendicular to the disc blade. The disc blade is, when the rotary cutter is in use, rotated in contact with the material to be cut in a controlled manner.

7 Claims, 9 Drawing Figures

HANDY ROTARY CUTTER

BACKGROUND OF THE INVENTION

The present invention relates to a handy rotary cutter of a type comprising a generally elongated handle and a disc blade rotatably carried by the handle at one end.

Various types of rotary cutters of the construction referred to above are well known. By way of example, U.S. Pat. No. 630,094, patented Aug. 1, 1899, discloses a rotary cutter which comprises a generally elongated handle, a stem member comprised of a pair of spaced plates of identical shape formed by folding a single metallic plate, such stem member being rigidly secured to one end of the handle and having a pair of spaced ear portions at a position opposite to the handle, a shaft having its opposed ends journalled by the ear portions, and a disc blade rigidly mounted on the shaft and positioned within the space between the spaced plates of the stem member.

A similar rotary cutter is also disclosed in U.S. Pat. No. 2,677,180, patented May 4, 1954. However, because of a limited field of application, the rotary cutter of the second mentioned U.S. patent further comprises a roller of generally truncated conical configuration rotatably mounted on the shaft between one of the ear portions and the disc blade for the purpose of preventing any possible penetration of the blade into the underlying wall when a web of paper adhering to the underlying wall is being cut.

Both of these conventional rotary cutters involve some common disadvantages. Specifically, even when the rotary cutter is not in use, the peripheral knife edge of the rotary blade is exposed to the outside and, therefore, the rotary cutter lacks a sufficient safety factor. In addition, since the disc blade is freely rotatable, the user or operator of the rotary cutter has to adjust the amount of a cutting force to be applied through the cutter to a material to be cut during the cutting operation and, at the same time, to adjust or control carefully the direction in which the cutting is to be performed. Unless care is taken in adjusting the amount of the cutting force and the cutting direction, the disc blade often runs over the material to be cut independently of the user's will even when a slight force is applied to the disc blade through the handle, resulting in a possible excessive cutting and/or damage to an area of the material not to be cut.

In general, with the prior art rotary cutters referred to above, due to the careful adjustment of the cutting force and the cutting direction required, a relatively large force is required to perform the cutting operation. This is particularly true when the cutting operation is performed subject to the material being placed on a hard, substantially polished support surface.

Although it does not appear to be pertinent to the present invention, the IBM Technical Disclosure Bulletin, Vol. 17, No. 10, March 1975, discloses a generally elongated handy safety knife comprising an elongated handle having one end to which a generally elongated knife blade is rigidly secured, a plate-shaped shaft having one end rotatably carrying a pair of guard rollers one on each side of the knife blade and the other end slidably housed within a slot in the handle, and a compression spring housed within the slot and interposed between the shaft and the handle for biasing the shaft in one direction to a projected position. In this safety knife, when the knife blade is applied to the material to be cut, the rollers are retracted against the biasing force of the compression spring to allow the tip of the knife blade to penetrate a predetermined distance into the material to be cut. When not in use, the rollers conceal the tip of the knife blade within the space between the rollers.

U.S. Pat. No. 4,020,550, patented May 3, 1977, the invention of which has been assigned to the assignee of the present invention, discloses the use of at least one elastic disc arranged in side-by-side relation to the disc blade and having a diameter larger than the diameter of the disc blade, a peripheral portion of the elastic disc being yieldable radially inwardly of the disc blade during the cutting operation to allow the peripheral knife blade to penetrate into the material to be cut. This U.S. patent also discloses the use of an adjustment mechanism for adjustably rotating the disc blade to enable different portions of the peripheral knife blade to be used at different times.

SUMMARY OF THE INVENTION

The present invention has been developed to substantially eliminate the disadvantages and inconveniences inherent in the prior art rotary cutter of the type disclosed in any one of the first and second mentioned U.S. patents and is intended to provide an improved handy rotary cutter effective to avoid any possible overrun of the disc blade.

Another important object of the present invention is to provide an improved handy rotary cutter of the type referred to above, which is provided with a guard disc for concealing the peripheral knife edge of the disc blade when the rotary knife is not in use.

A further important object of the present invention is to provide an improved handy rotary cutter of the type referred to above, which does not require the application of a relatively large force during the cutting operation and is safe for a school child to handle.

A still further object of the present invention is to provide an improved handy rotary cutter of the type referred to above, which is simple in construction and easy to assembly and, therefore, can be manufactured at a reduced cost.

In order to accomplish these and other objects of the present invention, the present invention provides an improved handy rotary cutter which comprises a handle of generally elongated plate-like configuration having one end carrying a disc blade. A fastening member for connecting the disc blade to the handle is constituted by a bolt having a flat head and a threaded stud, rotatably extending through the handle and the disc blade with the flat head positioned on one side of the handle remote from the disc blade, and a nut fastened to a free end of the threaded stud remote from the flat head of the bolt. In order to prevent a free, arbitrary rotation of the disc blade about the bolt, a biasing member is used for biasing the disc blade relatively against the handle to impart a friction or drag to the rotation of the disc blade.

The rotary cutter embodying the present invention may further comprise a guard disc mounted on the threaded stud for movement in a direction parallel to the longitudinal extent of the handle and perpendicular to the longitudinal axis of the bolt for selectively exposing and concealing the peripheral knife edge of the disc blade. This guard disc if employed may be positioned either between the flat head of the bolt and the disc blade or between the disc blade and the handle.

BRIEF DESCRIPTION OF THE DRAWINGS

These and other objects and features of the present invention will become apparent from the following detailed description taken in conjunction with preferred embodiments thereof with reference to the accompanying drawings, in which.

DETAILED DESCRIPTION OF THE INVENTION

Figure 1:
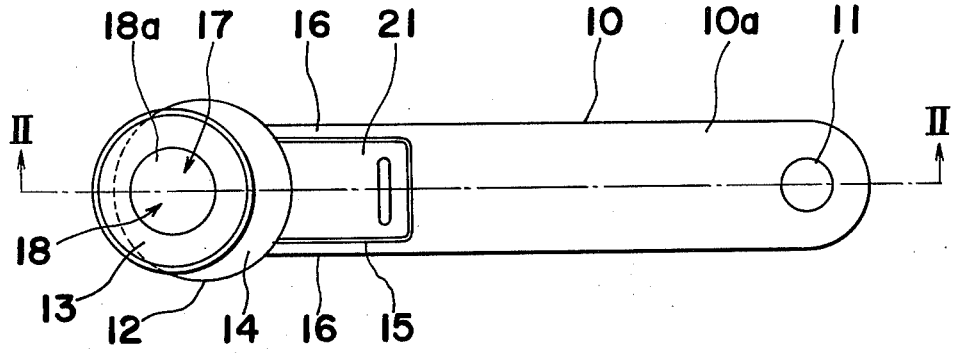
FIG. 1 is a top plan view of a rotary cutter according to a first preferred embodiment of the present invention, with a guard disc positioned in an exposing position.

Before the description of the present invention proceeds, it is to be noted that like parts are designated by like reference numerals throughout the several views of the accompanying drawings.

Figure 2:
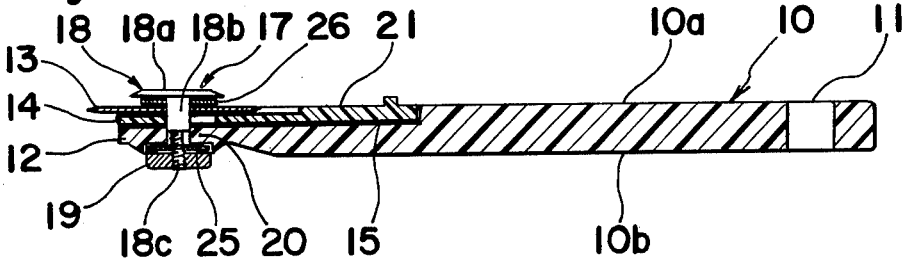
FIG. 2 is a cross sectional view taken along the line II—II shown in FIG. 1.
Figure 3:
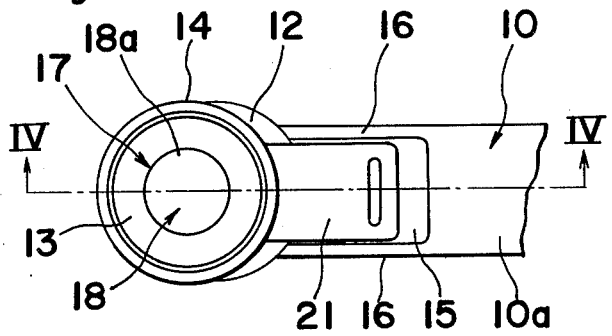
FIG. 3 is a view similar to FIG. 1, showing a portion of the rotary cutter with the guard disc held in a concealing position.
Figure 4:
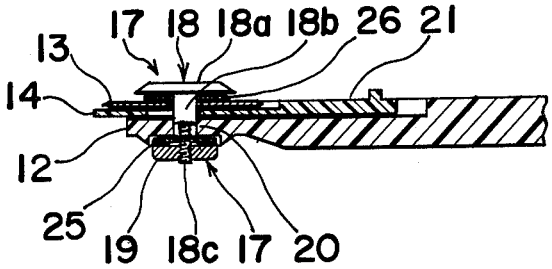
FIG. 4 is a cross sectional view taken along the line IV—IV shown in FIG. 3.

Referring first to FIGS. 1 to 5, a rotary cutter shown therein comprises a handle 10 of generally elongated plate-like configuration having a pair of opposed flat surfaces 10*a* and 10*b* and one end formed with an eye 11 for engagement with a hook or any other connecting element. The other end of the handle 10 is integrally formed with a generally circular platform 12 of a thickness less than that of the handle 10 in such a manner that one of the opposed surfaces of the platform 12 is positioned at a level offset downwardly of the level of the surface 10*a* of the handle 10, as viewed in FIGS. 2 and 4, while the other of the opposed surfaces of the platform 12 may be either flush with the surface 10*b* of the handle 10 or, as shown in FIGS. 2 and 4, at a level offset upwardly of the level of the surface 10*b* of the handle 10. In particular, the difference between the level of said one of the opposed surfaces of the platform 12 and that of the surface 10*a* of the handle 10 is substantially equal to or slightly larger than the sum of the thickness of a disc blade 13 and the thickness of a guard disc 14 for a reason which will become clear from the subsequent description.

Adjacent the platform 12, the handle 10 is formed with a generally rectangular recess 15 extending in alignment with the longitudinal axis of the handle 10 and having one end communicated to and opening into a space immediately above the platform 12, the depth of recess 15 being equal to the difference between the level of said one of the opposed surfaces of the platform 12 and that of the surface 10*a* of the handle 10, whereas the width of recess 15 is smaller than the width of the handle 10 so as to leave a pair of opposed guide walls 16, one on each side of the recess 15.

The disc blade 13 is rotatably mounted on the platform 12 by means of a fastening member 17 constituted by a bolt 18 and a nut 19, bolt 18 having a generally flat circular head 18*a* at one end thereof, a non-threaded stud 18*b* having one end fast with the flat head 18*a* and a threaded stud 18*c* having one end coaxially integral with the non-threaded stud 18*b*. The non-threaded stud 18*b* has a length preferably substantially equal to or slightly smaller than the sum of the thickness of the disc blade 13, the thickness of the guard disc 14 and the thickness of the platform 12 and is utilized to essentially support the disc blade 13 in coaxial relation thereto. For this purpose, in an assembled condition, the non-threaded stud 18*b* rotatably extends through a center aperture in the disc blade 13 and then through a bearing aperture 20 in the platform 12 with the flat head 18*a* positioned on one side of the disc blade 13 remote from the guard disc 14 and also with the threaded stud 18*c* positioned on one side of the platform 12 remote from the guard disc 14 and receiving the nut 19. It is to be noted that the bearing aperture 20 defined in the platform 12 is so positioned as to permit a portion of the peripheral knife edge of the disc blade 13 to protrude outwardly beyond the periphery of the platform 12 in a direction generally parallel to the longitudinal axis of the handle 10.

The guard disc 14 having a diameter larger than the diameter of the disc blade 13 is relatively slidably positioned between the platform 12 and the disc blade 13 and has a manipulatable slide 21 integrally formed with and radially outwardly protruding from the guard disc 14 and situated within the recess 15, manipulatable slide 21 having a thickness substantially equal to the depth of the recess 15 and slightly greater than the thickness of the guard disc 14 by an amount corresponding to the thickness of the disc blade 13, and a width substantially equal to the inside span between the opposed guide walls 16. The difference between the diameter of the guard disc 14 and that of the disc blade 13 is so selected as to permit the disc blade 13 to be concealed behind the guard disc 14 when the guard disc 14 is held in a concealing position as shown in FIGS. 3 and 4 by the manipulation of the manipulatable slide 21, but to allow a portion of the peripheral knife edge of the disc blade 13 to be exposed to the outside beyond the guard disc 14 when the disc blade 13 is held in an exposing position as shown in FIGS. 1 and 2 by the manipulation of the manipulatable slide 21 as will be described later in more detail.

Figure 5:
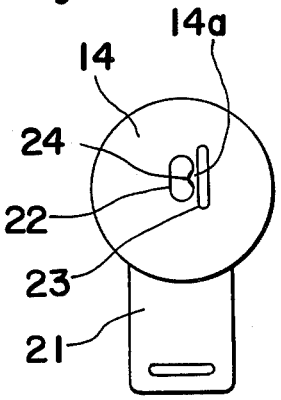
FIG. 5 is a top plan view of the guard disc employed in the rotary cutter shown in FIGS. 1 to 4.

In order to enable the guard disc 14 to move between the concealing and exposing positions, as best shown in FIG. 5, the guard disc 14 has defined therein a guide slot 22, the longitudinal extent of which is in alignment with the longitudinal axis of the slide 21 and passes through the center of the circle assumed by the guard disc 14, and an escapement slot 23 extending generally in parallel to and in side-by-side relation to the guide slot 22. The guide slot 22 has a width substantially equal to the diameter of the non-threaded stud 18*b* of the bolt 18 and also has a lobe 24 defined on one side edge of the guide slot 22 adjacent the escapement slot 23 and protruding a predetermined distance laterally into the guide slot 22. The predetermined distance through which the lobe 24 protrudes into the guide slot 22 is so selected that, while the non-threaded stud 18*b* of the bolt 18 extends through the guide slot 22 when the rotary cutter is in the assembled condition, the guard disc 14 can move between the concealing and exposing positions on one hand and, during the movement of the guard disc 14 from one of the concealing and exposing positions towards the other of the concealing and exposing positions relative to the non-threaded stud 18*b* of the bolt 18, the non-threaded stud 18*b* contacts the lobe 24 to urge a portion 14*a* of the guard disc 14 between the slots 22 and 23 towards the escapement slot 23 against the resiliency of that portion 14*a* of the guard disc 14. In other words, the escapement slot 23 is provided for accommodating the lateral displacement of that portion 14*a* of the guard disc 14 which takes place against the resiliency of that portion 14*a* of the guard disc 14 when the non-threaded stud 18*b* of the bolt 18 contacts the lobe 24 to widen the width of the guide slot 22 during the movement of the guard disc 14 from one of the concealing and exposing positions towards the other of the concealing and exposing positions.

It is to be noted that, if the guard disc 14 were made of a pliable material, such as rubber, of a type sufficient for the lobe 24 to be substantially flattened in contact with the non-threaded stud 18*b* of the bolt 18, the escapement slot 23 may not be always necessary. However, in consideration of the fact that the guard disc 14 when in the concealing position serves to conceal the disc blade 13 thereby to avoid the access of the user of the rotary cutter or any other persons to the peripheral knife edge of the disc blade 13, the use of such pliable material of the type referred to above is not preferred.

Because of the provision of the lobe 24 protruding the slight distance into the guide slot 22, it will readily be seen that the guard disc 14 can be clicked from one of the concealing and exposing positions into the other of the concealing and exposing positions, thereby avoiding any possible arbitrary movement of the guard disc 14 between the concealing and exposing positions.

The fastening member 17 includes a biasing member 25, which may be an annular spring disc, a bevel washer, a coil spring, an annular elastic rubber block or a helical washer. This biasing member 25 is, when the rotary cutter is in the assembled condition as shown in FIGS. 1 to 4, held between the nut 19 and the platform 12 and applies, in a direction axially of the bolt 18, a biasing force necessary to enable an annular inside face of the head 18*a* of the bolt 18 to uniformly contact the disc blade 13 so that, during the cutting operation, the disc blade 13 can rotate about the bolt 18 in contact with the material to be cut in a controlled manner, that is, without any arbitrary rotation. The magnitude of the biasing force exerted by the biasing member 25 can be adjustable by adjusting the position of the nut 19 relative to the threaded stud 18*c* of the bolt 18.

If desired, an annular friction pad 26 may be employed. As illustrated, the annular friction pad 26 is shown as positioned between the flat head 18*a* of the bolt 18 and the disc blade 13, however, it is to be understood that it may be positioned at any position as long as the direct contact of the friction pad 26 to the disc blade 13 is achieved. If this annular friction pad 26 is employed as shown, the biasing force exerted by the biasing member 25 may be smaller than that required without the annular friction pad 26.

Figure 6:
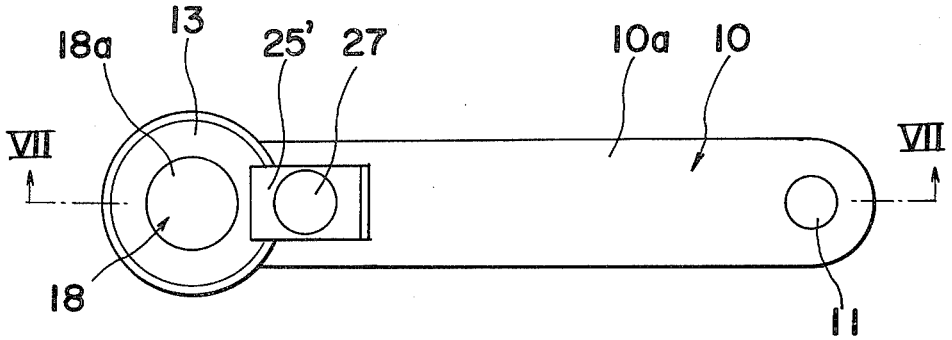
FIG. 6 is a view similar to FIG. 1, showing a rotary cutter according to a second preferred embodiment of the present invention.
Figure 7:
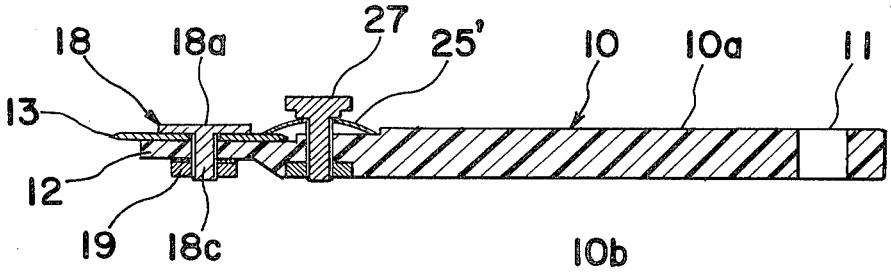
FIG. 7 is a cross sectional view taken along the line VII—VII shown in FIG. 6.

In the embodiment shown in FIGS. 6 and 7, the rotary cutter shown therein is of a construction simpler than that shown in FIGS. 1 to 4. The rotary cutter in this embodiment of FIGS. 6 and 7 does not make use of the guard disc 14 and its associated component parts, and the fastening member 17 does not include the biasing member 25 described in the foregoing embodiment. Instead thereof, a biasing member 25' is employed in the form of a generally rectangular curved leaf spring mounted on the handle 10 by means of a connecting member 27, composed of a bolt and nut, with its opposed ends contacting respectively the disc blade 13 and the handle 10. In this construction, it will readily be seen that the biasing force exerted by the biasing member 25', that is, the generally rectangular curved leaf spring, is transmitted to the disc blade 13 to control the rotation of the disc blade 13 about the bolt 18, which takes place in contact with the material to be cut while an external pushing force is applied to the handle 10. As is the case with the biasing member 25 in the foregoing embodiment, without the biasing member 25', the disc blade 13 tends to overrun against the external pushing or pulling force the user of the rotary cutter may apply to the handle 10 during the cutting operation, thus requiring careful operation to attempt to avoid any possible excessive cutting of the material being cut.

Figure 8:
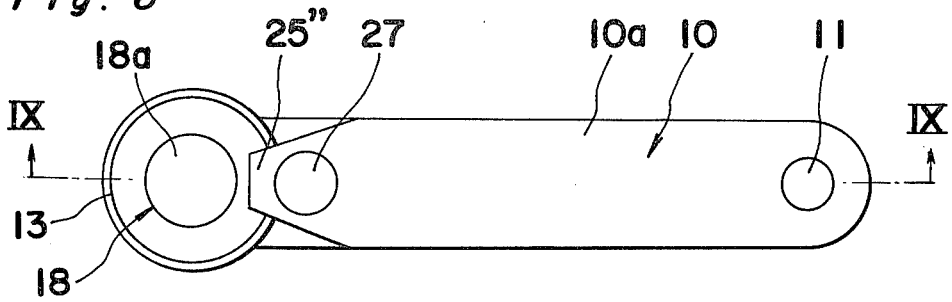
FIG. 8 is a view similar to FIG. 1, showing a rotary cutter according to a third preferred embodiment of the present invention.
Figure 9:
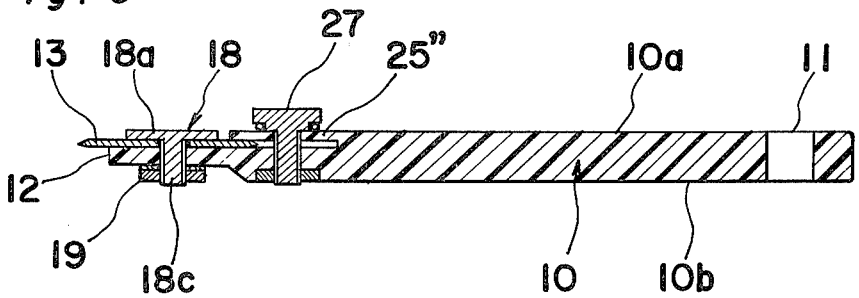
FIG. 9 is a cross sectional view taken along the line IX—IX shown in FIG. 8.

In the embodiment shown in FIGS. 8 and 9, a biasing member 25'' is integrally formed with the handle 10 and protrudes longitudinally therefrom in a direction towards the bolt 18 in spaced relation to the adjacent end portion of the handle 10 and the platform 12, the space between such end portion of the handle 10 and the platform 12 and the biasing member 25'' being substantially equal to or slightly larger than the thickness of the disc blade 13. In this arrangement, due to a relatively small thickness of the biasing member 25'' relative to the thickness of the handle 10, by fastening the nut of the connecting member 27 to the bolt of the connecting member 27, the biasing member 25'' yields against its own resiliency with the free end thereof contacting the disc blade 13 to apply the biasing force to disc blade 13.

From the foregoing description of the present invention, it has now become clear that, because of the rotation of the disc blade 13 controlled by the biasing member, there is no possibility that the disc blade 13 runs over the material to be cut independently of the control of the user and, therefore, any possible excessive or insufficient cutting can advantageously be avoided. In addition, for the same reason, an advantageously minimized cutting force to be applied by the user is sufficient to perform the cutting operation.

More specifically, in the prior art rotary cutter such as disclosed in the above first mentioned U.S. patent, the cutting operation relies on the load the user of the cutter applies vertically downwardly to the handle while the latter is held at an acute angle relative to the material to be cut, during the rotation of the disc blade with the peripheral knife edge in contact with the material being cut. Because of this, a relatively large cutting force is required in the prior art rotary cutter in performing the cutting operation, even with respect to a thin web of fabric, to such an extent as may cause the user to become readily tired.

On the contrary thereto, in the present invention, since a braking effect is applied to the disc blade 13 by the biasing member, which braking effect corresponds to the amount of the load theoretically required to cut the material in practical use, the cutting operation can surprisingly easily be performed with a minimized cutting force. Nevertheless, during the cutting operation with the rotary cutter embodying the present invention, the disc blade 13 forcibly cuts into the body of the material to be cut and rotates in a controlled manner in contact with the material to be cut. Although it is not clear why the application of the frictional force to the disc blade being rotated in contact with the material to be cut during the cutting operation results in such an advantage, it appears to be because the peripheral knife edge of the disc blade shears into the material being cut as it rotates in a controlled manner without diverting from the intended course of cutting.

Although the present invention has fully been described in connection with the preferred embodiments thereof, it is to be noted that various changes and modifications are apparent to those skilled in the art. By way of example, in the embodiment shown in FIGS. 1 to 4, although the disc blade has been described as positioned between the guard disc 14 and the flat head 18*a* of the bolt 18, it may be positioned between the platform 12 and the guard disc 14. In addition, the disc guard having the manipulatable slide may be employed in each of the embodiments shown respectively in FIGS. 6 and 7 and FIGS. 8 and 9. Moreover, the fastening member including the bolt and the nut may constitute the biasing member if the platform 12 is formed with a circular recess so that, when the nut is fastened relative to the bolt, the wall defining the bottom of such circular recess can be deformed with a peripheral portion of the platform held in contact with the disc blade to apply the frictional force thereto. Also, the disc blade is made in various sizes of abrasion resisting material suitable for cutting a sheet of paper, fiber, film, rubber, vinyl, wood, metal or glass such as special steel, iron alloy, cemented or sintered carbides, extra superduralumin and the like.

Accordingly, such changes and modifications are to be understood as included within the true scope of the present invention unless they depart therefrom.

What is claimed:

1. A rotary cutter comprising:

an elongated handle having extending through one end thereof a bearing aperture;

a shaft extending through said aperture and supported by said handle;

a disc blade rotatably mounted on said shaft and lying in a plane extending perpendicular to the longitudinal axis of said shaft;

a guard disc having a diameter greater than the diameter of said disc blade, said guard disc having therein a guide slot, said guard disc being mounted at said one end of said handle, with said shaft extending through said guide slot, for sliding movement in opposite directions longitudinally of said handle between an exposing position, whereat a portion of the periphery of said disc blade is exposed for cutting, and a concealing position, whereat said portion of said periphery is concealed by said guard disc; and means for adjustably applying a friction force to said disc blade in a direction substantially perpendicular thereto, and for thereby enabling said disc blade to be rotated in a controlled manner in contact with material to be cut.

2. A cutter as claimed in claim 1, wherein said guard disc includes a lobe protruding a slight distance into said guide slot for enabling said guard disc to be clicked into and retained in one of said concealing and exposing positions from the other of said concealing and exposing positions.

3. A cutter as claimed in claim 2, wherein said guard disc has therein an escapement slot adjacent to and extending in parallel relation to said guide slot for accommodating lateral displacement of said lobe which may take place due to contact of said shaft with said lobe during movement of said guard disc between said concealing and exposing positions.

4. A cutter as claimed in claim 1, wherein said shaft member comprises a bolt having a flat head and a nut fastened to said bolt, with said disc blade and said one end of said handle being positioned between said head of said bolt and said nut, and said applying means comprises a biasing member positioned between said nut and said one end of said handle.

5. A cutter as claimed in claim 1, wherein said applying means comprises a generally elongated biasing member mounted on said handle, said biasing member having one end held slidingly in contact with said disc blade.

6. A cutter as claimed in claim 5, wherein said biasing member comprises a generally rectangular curved leaf spring, said leaf spring being mounted on said handle by means of a bolt and nut.

7. A cutter as claimed in claim 5, wherein said biasing member is integrally formed with said handle and extends in overlapping and spaced relation to said one end of said handle, and a bolt and nut, said bolt extending through said biasing member and then through said handle and receiving said nut, the free end of said biasing member being held slidingly in contact with said disc blade when said nut is fastened to said bolt.

* * * * *